US006824412B2

(12) United States Patent
Clement

(10) Patent No.: US 6,824,412 B2
(45) Date of Patent: Nov. 30, 2004

(54) AUTO-LATCHING SLIDING CONTACT MECHANISM ENABLING IMPEDANCE MATCHING BETWEEN TWO CONNECTORS

(75) Inventor: Jean-Yves Clement, Saint Jeannet (FR)

(73) Assignee: International Business Machines Corporation, Armonk, NY (US)

( * ) Notice: Subject to any disclaimer, the term of this patent is extended or adjusted under 35 U.S.C. 154(b) by 4 days.

(21) Appl. No.: 10/460,442

(22) Filed: Jun. 12, 2003

(65) Prior Publication Data

US 2004/0038580 A1 Feb. 26, 2004

(30) Foreign Application Priority Data

Aug. 22, 2002 (EP) ..... 02368093

(51) Int. Cl.[7] ..... H01R 13/28
(52) U.S. Cl. ..... 439/290; 439/409
(58) Field of Search ..... 439/290, 291, 439/409, 660, 346

(56) References Cited

U.S. PATENT DOCUMENTS 2,744,244 A * 5/1956 Schumacher et al. ..... 439/290
5,857,867 A * 1/1999 Henry ..... 439/290
6,186,821 B1 * 2/2001 Mullen, Jr. ..... 439/409
6,254,421 B1 * 7/2001 Denovich et al. ..... 439/409

* cited by examiner

*Primary Examiner*—Gary Paumen
(74) *Attorney, Agent, or Firm*—John R. Pivinichny; David R. Irvin

(57) ABSTRACT

A connector for twisted pair cables used to transmit high frequency data signals. The conductors of the twisted pair are connected to contact blades by an auto-latching mechanism adapted to ensure contact with the corresponding contact blades of a mating connector. Each contact blade has constant thickness but has an initial width in its rectilinear part and a narrower second width in the portion where contact is made with the corresponding portion of the contact blade of the other connector, such that the common mode impedance is the same in the rectilinear part and in the portion where the contact takes place.

15 Claims, 8 Drawing Sheets

AUTO-LATCHING SLIDING CONTACT MECHANISM ENABLING IMPEDANCE MATCHING BETWEEN TWO CONNECTORS

FIELD OF THE INVENTION

The present invention relates generally to a shielded electrical connector for terminating a cable assembly of multi-pair shielded cable used for transmitting high frequency data signals, and relates in particular to an auto-latching sliding contact mechanism that matches the impedance between two connectors.

BACKGROUND

Several problems become evident in data transmission networks when data is transmitted at high frequency over multi-pair shielded cable. In particular, at high transmission rates each wiring circuit itself both transmits and receives electromagnetic signals, so that the signals flowing through one circuit or wire pair may couple with the signals flowing through another circuit. The unintended electromagnetic coupling of signals between different pairs of conductors of different electrical circuits is called cross-talk, and is a source of interference that often adversely affects the processing of these signals.

Another problem occurs at the point of interconnection between a male connector and a female connector. Contact is made automatically at the interface between the two connectors when the male connector is introduced into the female connector. Such contact must both ensure electrical continuity and provide stability to prevent the two connectors from being easily separated. A mechanism for providing stable contact is described in European patent application EP 0.634.817, wherein the contacts of both connectors are identical and have an elongated base portion and a reversely directed cantilevered spring portion separated by a rounded bump. When the two connectors are interconnected, the rounded bump of the male connector comes in behind the other bump due to the lowering of the two cantilevered spring portions, resulting in an auto-latching electrical contact between the two connectors.

Unfortunately, even though such an auto-latching contact has the advantage of requiring no other mechanical locking, it also has an important drawback when used to transmit data signals at a very high frequency due to the geometrical discontinuity at the point of contact. Indeed, at this point there are at least two layers of contact blades, which results in a difference of thickness across the point of contact. Such a difference causes a discontinuity in the common mode impedance that is detrimental when the frequency is higher than 600 MHz, and especially as the frequency approaches 1200 MHz.

SUMMARY

Accordingly, an object of the invention is to provide an auto-latching sliding contact mechanism without discontinuity of the common mode impedance across the point of contact.

The invention includes a connector designed to be interconnected to another connector of the same type to connect cables containing twisted pair for the transmission of very-high-frequency differential data signals. The conductors of the pair are connected in a connection block by means of Insulation Displacement Contacts (IDC) to contact blades that include an auto-latching mechanism adapted to ensure contact in a interface block with the corresponding contact blades of the other connector. Each of the contact blades has a constant thickness, and has an initial width (W) in its rectilinear part and a narrower second width (Wc) in the portion where the contact is made with the corresponding portion of the contact blade of the other connector, such that the common mode impedance is equal to:

$$Zc = \frac{60}{\sqrt{\varepsilon r}} \mathrm{Ln}\left(\frac{1.9B}{0.8W + T}\right),$$

where Ln stands for neperian logarithm, and B=2H+T, where H is the distance between the middle point of the base of the blade and the wall of the cavity, and is the same in the rectilinear part and in the portion where the contact takes place when Wc=W−1.25T.

BRIEF DESCRIPTION OF THE DRAWINGS

The above and other objects, features, and advantages of the invention will be better understood by reading the following more particular description of the invention in conjunction with the accompanying drawings, wherein.

DETAILED DESCRIPTION

Figure 1:
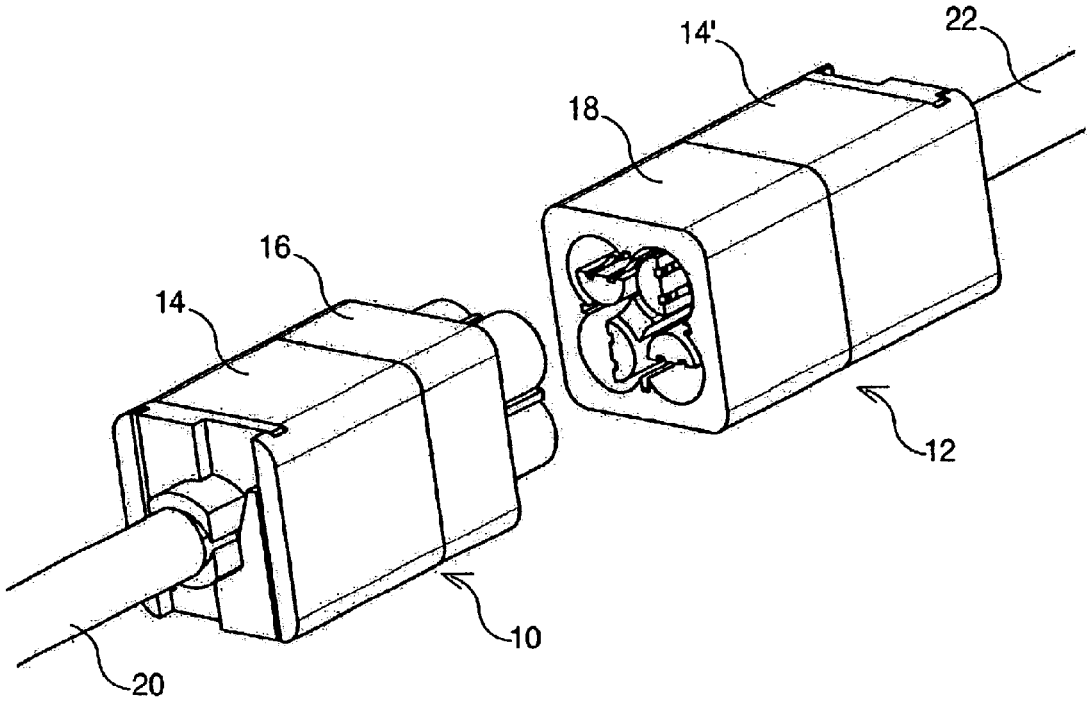
FIG. 1 is a perspective view showing a male connector and a female connector before their connection together.

The connector according to the invention is designed to interconnect with another connector of the same type, but of the opposite gender. In this manner, as shown in FIG. 1, the male connector 10 is adapted to connect with the female connector 12. This type of connector is said to be "semi-hermaphroditic" because, although the connectors are different in their external appearances, they feature hermaphroditic contacts, as will be described below.

Semi-hermaphroditic connectors have lower manufacturing costs than hermaphroditic connectors, because fewer different parts need to be made, and thus fewer different kinds of molds and cutting tools are needed. Further, semi-hermaphroditic connectors do not require the same degree of precision in maintaining tolerances that is required by hermaphroditic connectors to ensure perfect interconnection. In the case of hermaphroditic connectors, modifying a dimension of one of the two connectors necessitates the same modification on the other connector. As a connector includes various elements, managing an interface dimension tolerance change becomes very difficult, especially in the case of multiple sourcing.

On the other hand, when a semi-hermaphroditic configuration is used, as in the case of the invention, the production of golden females, for example, allows different families of male connectors to be produced in different manufacturing locations without influencing the fabrication of the female connectors, and vice versa. Among other considerations, the relative alignment of the common parts, such as the contact supports, is possible by adjusting their positions inside the connector body.

Each connector has a metallic body that includes a connection block 14 or 14' used to connect the cable to the connector, which is identical for each male or female connector, and an interface block 16 or 18, which is different depending on whether the connector is male or female. The connection and interface blocks may be merged into a single part. In this case, only two different molds are required to manufacture the connectors, rather than three.

Although the cables 20 and 22, interconnected by connectors 10 and 12 according to the invention, are multiple-pair cables that may include any arbitrary number of pairs, the cables shown in the illustrative embodiment described here have four pairs. Thus, each connector, whether it is male or female, includes four cylindrically shaped cavities as shown in FIG. 1, in which are located the hermaphroditic contacts designed to ensure the electrical connection between each twisted pair of the male connector and each twisted pair of the female connector.

Figure 2:
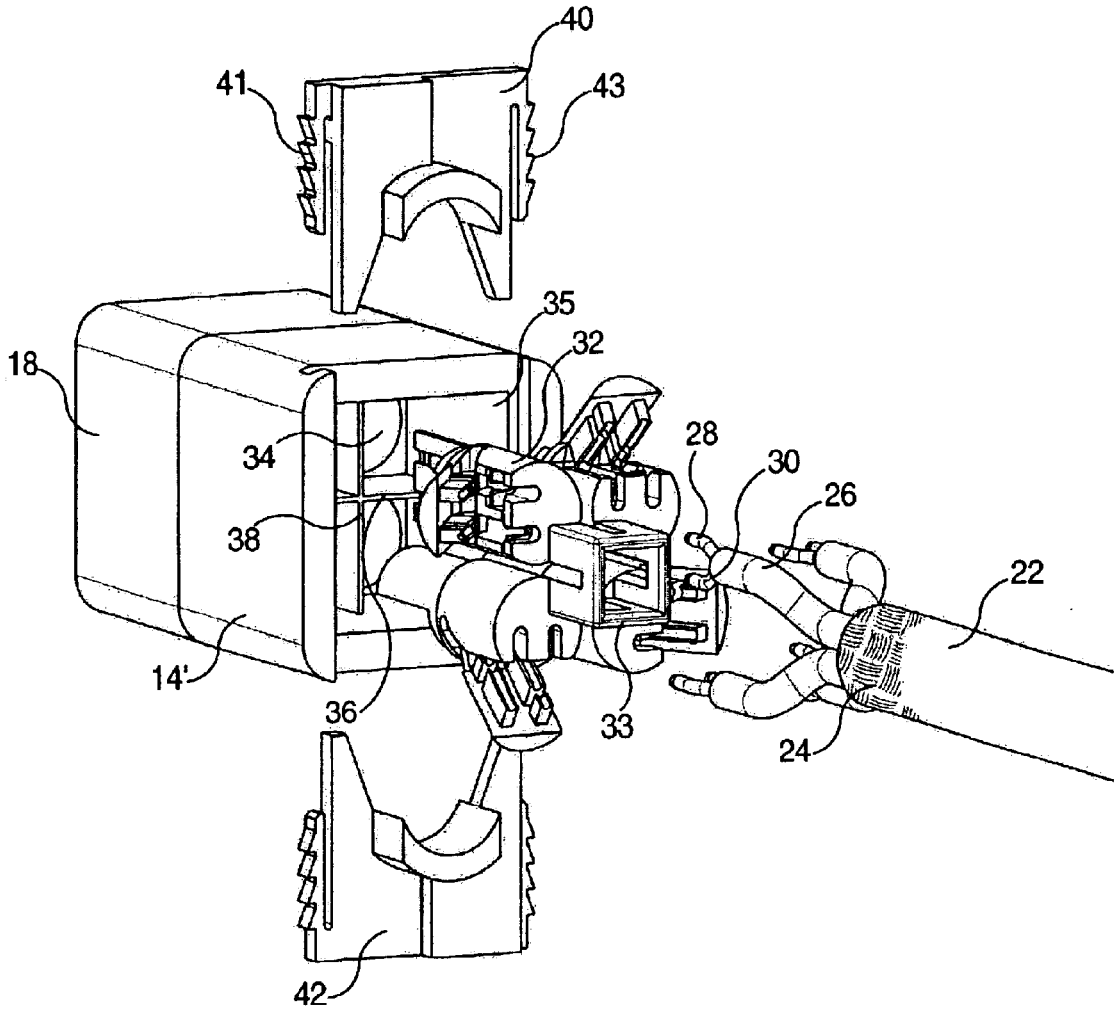
FIG. 2 is a perspective and partially exploded view representing the female connector, the dressing-blocks, and the cable before the insertion of the conductors of each pair into insulation displacement contacts (IDC).

As shown in FIG. 2, each cable 20 or 22 is first stripped by removing part of the end of the outer jacket and the shielding braid 24 so as to separate the four pairs which are wound together to form a strand. This shielding ensures that the cable is isolated from external electromagnetic disturbances, and maintains the pairs against one another. The conductors 28 and 30 of each pair 26 are insulated by a plastic sheath and twisted together to form the transmission line, the electrical characteristics of which are defined by geometric parameters such as the diameter of the conductors, the diameters of the insulating material, and the twist pitch. In order to meet high performance criteria, particularly in terms of isolation, each pair is individually shielded. The two conductors 28 and 30 of the pair are then connected to the connector's contacts by a dressing-block 32.

It should be noted that the four dressing-blocks 32 may be molded in one single piece, two parts, or four separate parts. The illustrative embodiment of FIG. 2 shows single pieces held together by an optional support 33.

The connection block 14' (as all the connection blocks) has four cylindrical cavities 34 designed to receive the dressing-blocks 32, and a cavity 35 in front of the connection block designed to house the four pairs of conductors, still wrapped in their individual shielding. This cavity 35 is divided in half along its depth into four insulation sub-cavities by two orthogonal conducting walls 36 and 38. These walls ensure the transition of the shielding between the part of the cable where the shields of the pairs are in mutual contact (a location where the pairs are well insulated by their insulating sheaths) and the part where the pairs are separated, where the individual shields stop. The rear of the connection block is closed by two diaphragm-type guillotines 40 and 42, which will be described below, which ensure both electrical continuity (ground connection) and a good seal against external contaminants by exerting pressure on the cable shielding.

Figure 3:
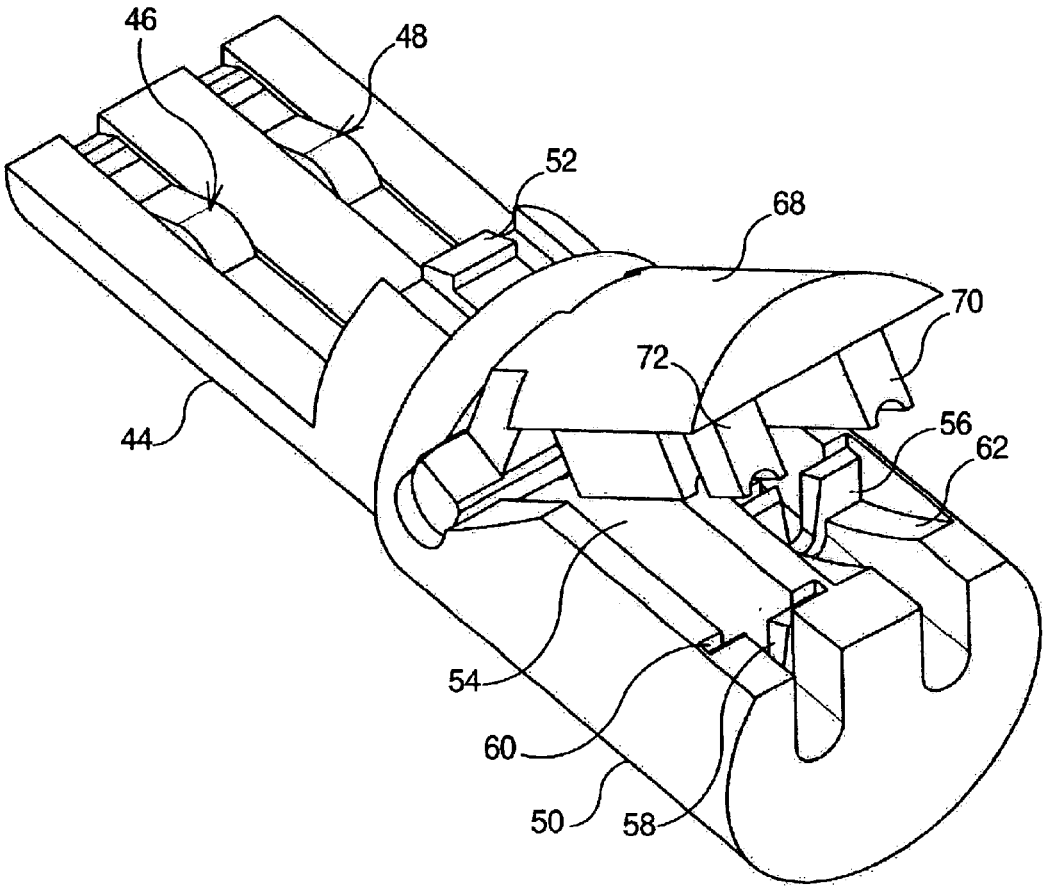
FIG. 3 is a perspective view of a dressing-block in which the closing lever has been raised before the insertion of the conductors of the pair.

Each dressing-block 32, as illustrated in FIG. 3, has a front part 44 made of plastic which supports the two contact blades 46 and 48 designed to ensure the connection with the other connector of opposite gender, and a rear part 50, also made of plastic, used to connect the two conductors of the pair by traditional insulation displacement contacts (IDC). When the connection is complete for the four dressing-blocks, the assembly is fully inserted into the connection block of the connector until the catches 52 for each dressing-block lock the assembly in the connector. In this position, the front parts 44 of the dressing-blocks are located inside the connector's interface block, and the rear parts 50 are located in the cylindrical cavities 34 of the connection block (see FIG. 2). The cylindrical cavity 34, which extends to the end of the interface block, has constant geometric characteristics over the entire length of the connector so as to maintain constant electrical characteristics.

Figure 4A:
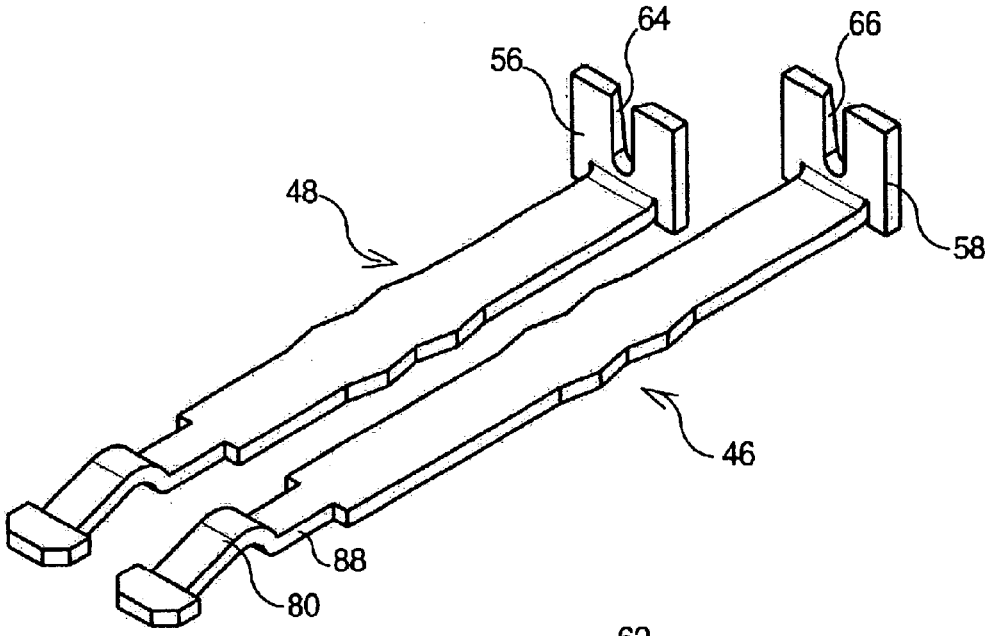
FIGS. 4A and 4B represent a perspective view of the contact blades and the dressing-block without its closing lever before the insertion of the blades into the dressing-block.
Figure 4B:
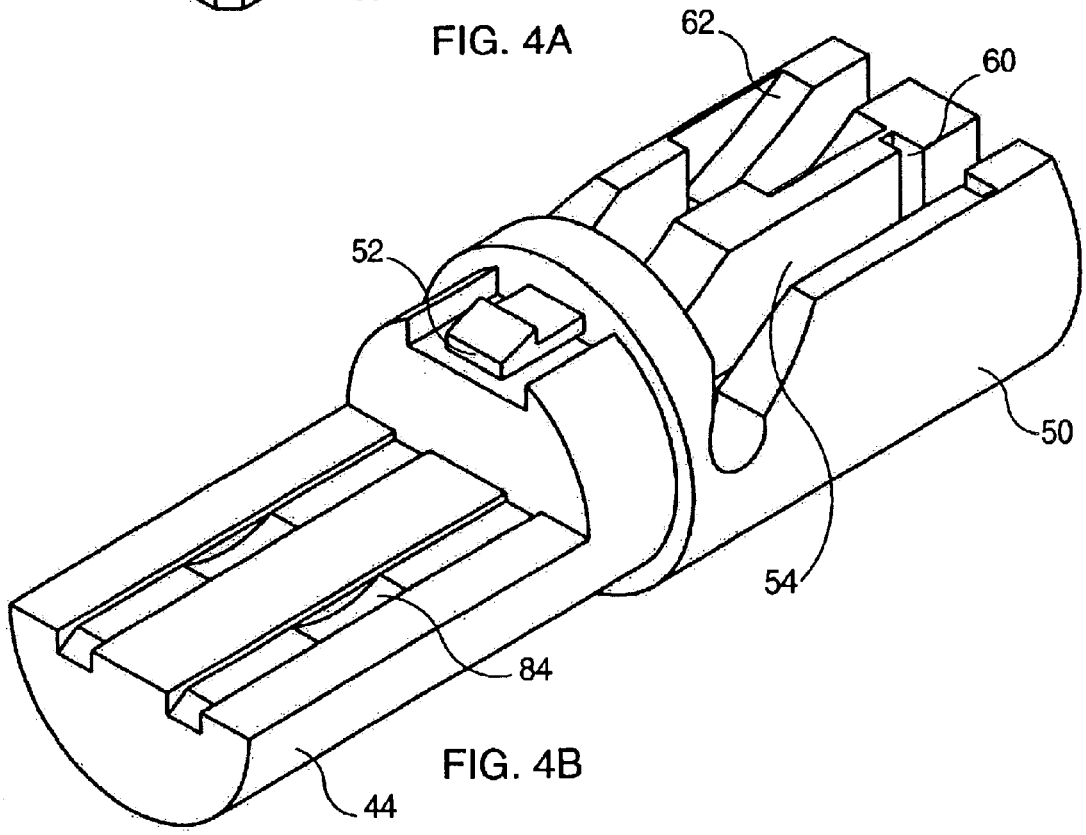

The rear part 50 of each dressing-block has two slides 54 into which the two contact blades 46 and 48 are introduced. As shown in FIGS. 4A and 4B, which represent the dressing-block and the contact blades which have not yet been inserted into the dressing-block, contact blade 48 is shorter than contact blade 46. The IDCs 56 and 58 are designed to have lengths which prevent them from being placed side by side, in order to prevent them from coming into contact, as could happen if both blades were the same length. In the latter case, in order to prevent contact, a space would be required between both contact blades which would be excessive in order to preserve the electrical parameters of the line.

When a connection is made, each IDC is introduced into its respective slide, such as the slide 60 for the IDC 58 visible in FIG. 4B (the slide in which the IDC 56 is inserted is not visible in the figure). The dressing-block may have a chamfer 62 at the front of the slide intended to receive the IDC 56, the purpose of which chamfer is to introduce the contact blade 48 without permanently distorting it.

In order to ensure that each conductor of a pair is connected, the conductors are introduced into the slides 54 whose lengths are calculated so that the vertical cutting sides 64 or 66 make solid contact with the insulation of each conductor. The pair is introduced into the dressing-block so that its shielding 26 (see FIG. 2) comes into contact with the rear of the dressing-block body, which ensures the continuity of the shielding with the cylindrical cavity 34. In the embodiment described here, the IDCs form an integral part of the contact blades.

The dressing-block has a closing lever 68, rotating around a pin, which is lowered when the pair is introduced into the dressing-block. When lowered, the lever 68 forces the conductors to enter the IDCs 56 and 58. The sharp vertical sides 64 and 66 slit the insulation and penetrate into the conductor's copper, thus ensuring a durable electrical contact. This quick and easy procedure is especially helpful when cables must be connected at sites where local networks are being installed. The lever closing operation is repeated on the four dressing-blocks before the assembly is inserted into the connector as described previously. The closing lever has retaining elements such as elements 70 and 72, the lower portion of which have semicircular profiles in order to exert a retaining force on the conductors in the slides 54 when the closing lever has been pressed downward.

The connector described above is designed to comply with the transmission characteristics of a pair-shielded cable as closely as possible. As such, it features cylindrical cavities 34 (see FIG. 2) and extension 74 (see FIG. 5A) so as to maintain a more constant distance between the conductors and the ground of the connector's ground. This type of geometry improves the linearity of the differential mode impedance between the two conductors as well as the impedance between the conductors and the shielding of the connector (common mode impedance), which is not the case when there are sharp angles and planes at 90° that require the high frequency return currents to change directions in the body of the connector.

Continuity between the circular type geometry of the connection block and the circular type geometry of the interface block is important to the invention. This continuity reduces the interface's return loss and thus reduces the attenuation, which has become a crucial parameter in terms of current industry standards activities (category 8 of the ISO standards) applied to transmission frequencies above 600 MHz and which may exceed 1.2 GHz.

Figure 5A:
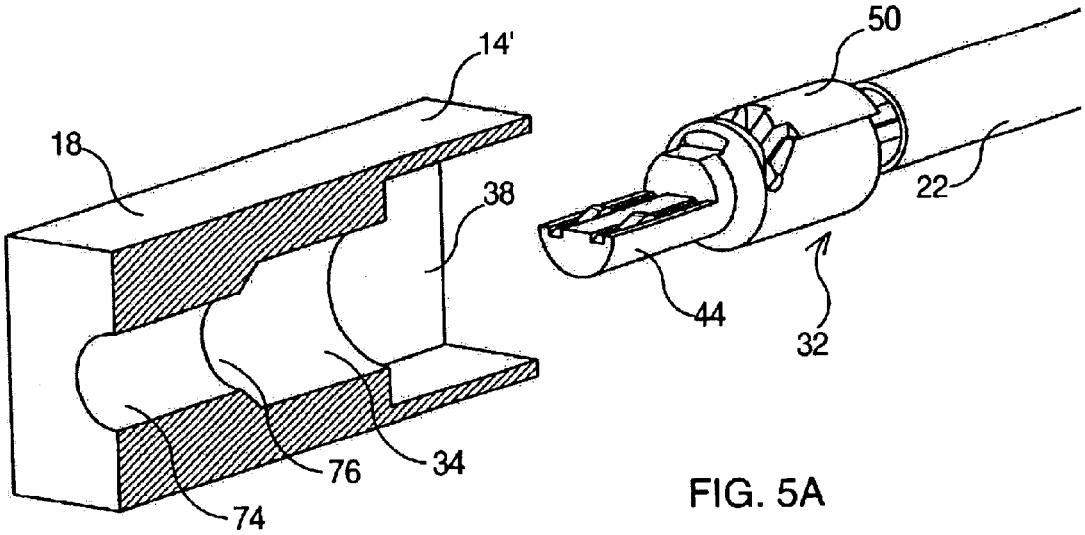
FIGS. 5A and 5B represent a longitudinal section of the connector cavity showing the inside cavities and the dressing-block connected to the cable before and after the insertion of the dressing-block into the connector.
Figure 5B:
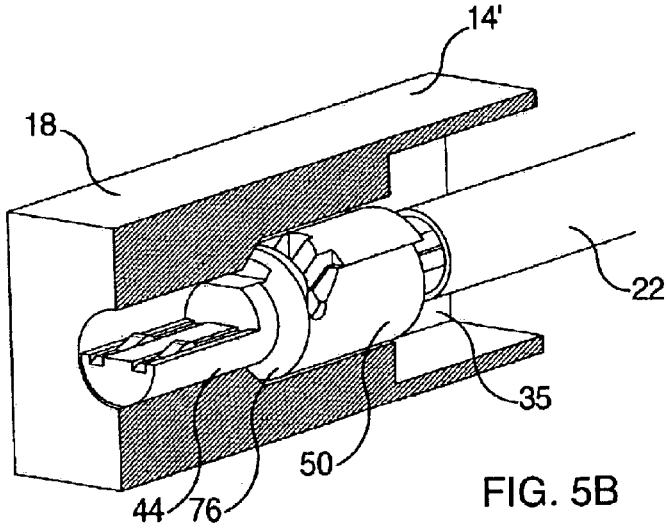

The description now refers to FIGS. 5A and 5B, which represent the longitudinal section of the connector showing the cavities into which the dressing-block and contact blade assembly is integrated, both before and after the insertion of this assembly into the connector. The cylindrical cavity into which the dressing-block 32 is inserted is terminated by a first cylindrical cavity having a circular section of small diameter 74 in which the front part 44 of the dressing-block is incorporated, and which is located in the interface block, and a second cylindrical cavity with a circular section of larger diameter 34 in the same axis as the first cavity. This portion of larger diameter 34 is located inside the connection block and receives the rear portion 50 of the dressing-block. Both cavities 34 and 74, while having different diameters in the embodiment described here, may have the same diameter. The important point is that their geometries are the same (concentric cylindrical shapes) and that they have the same proportions as the conductors. In addition, the transition zone 76, which has the shape of a truncated cone in this embodiment, should not have sharp angles, so that it does not disturb the return currents circulating in the body of the connector and thereby cause parasitic reflections.

In order to ensure the best possible geometric continuity, the cable 22 must be mounted in the connection block so that the shielding of each pair of conductors 26 ends up in the second cylindrical cavity 34 where the connection takes place. In this manner, the environment that the pair will encounter in the cavity 35 (where the wall 38 is located) which is not cylindrical will not influence the electrical parameters. For this reason, the walls 36 and 38 of the cavity 35 (see FIG. 2) are not involved in the transmission parameters. They are designed solely to isolate the pairs from one another in order to reduce diaphony between pairs.

The geometric continuity of the connector described above provides an important characteristic of the invention, according to which the differential mode impedance of the twisted pair derived from the cable is equal to the differential mode impedance of the connector, particularly in the area of the contact blades.

The differential mode impedance of a twisted pair is given by:

$$Z_{pd} = \frac{120}{\sqrt{\varepsilon r}} \mathrm{Ln}\left(X \cdot \frac{b^2 - s^2}{b^2 + s^2}\right)$$

where Ln stands for neperian logarithm, er is the relative permittivity, b is the inside diameter of the shield (shielding), s is the distance between the centers of the conductors, and X=2s/d, where d is the diameter of the conductors. The value of the impedance is thus determined by the cable. The dimensional parameters of the connector after the IDC are adapted so that the value of the differential mode impedance of this part of the connector is the same. This is possible with the present invention, which provides geometric continuity, whereas this is not possible with connectors according to the prior art, which do not provide geometric continuity.

The same is true concerning the common mode impedance of the twisted pair, which is equal to the common mode impedance of the connector, particularly in the area of the contact blades. For the twisted pair, this impedance is given by:

$$Z_{pc} = \frac{60}{\sqrt{\varepsilon r}} \mathrm{Ln} A \cdot \frac{b}{d}$$

where A is an experimental coefficient having a value between 1 and 2.

Figure 6:
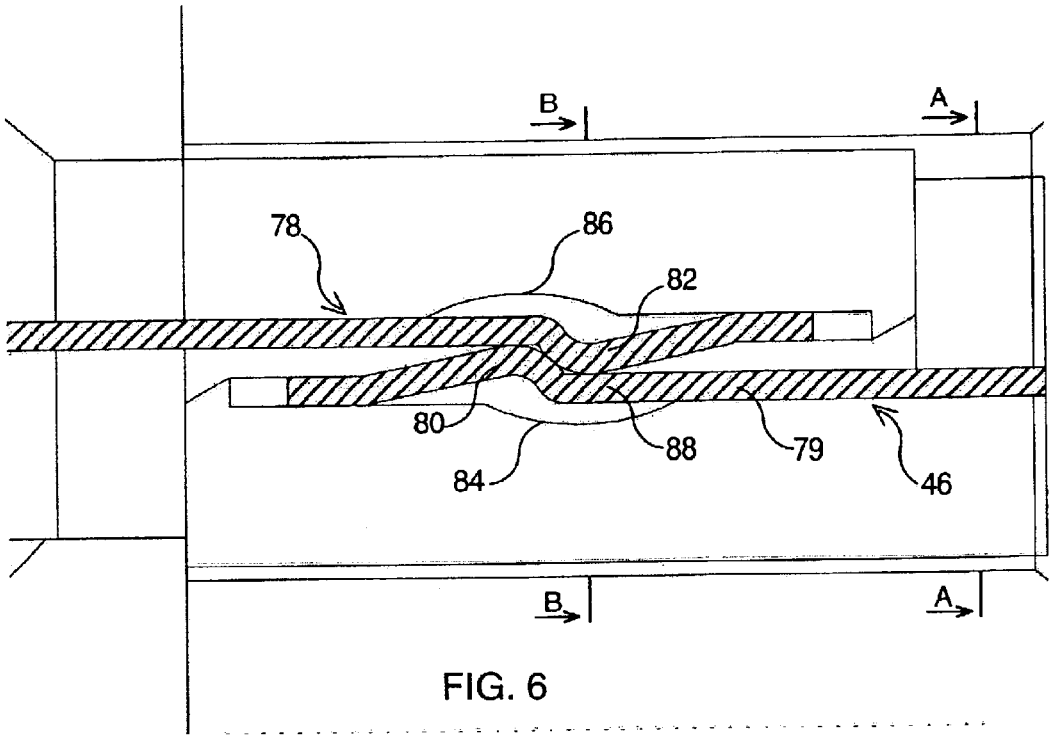
FIG. 6 is a longitudinal view of the contact blades of the male and female connectors in contact with each other after the two connectors have been connected together.

As shown in FIG. 6, the contact between a male connector and a female connector is provided by a contact blade 46 in the first connector and a contact blade 78 in the second connector. These blades are identical in shape, as mentioned previously. In each connector, the contact blade is connected to the sharp part of the IDC, for example the sharp part 66 of the IDC 58 for the contact blade 46. The contact blade is placed in a groove of the front part 44 of the dressing-block (see FIG. 4B) and has teeth to hold it in place in the groove (see FIG. 4*a*).

After a rectilinear portion 79, each contact blade, such as blade 46, includes a stiff side terminated by a rounded bump 80 for the blade 46 or 82 for the blade 78, and a slightly inclined plane terminating at the end of the blade. When the interface block of the male connector is inserted into the interface block of the female connector, the two slightly inclined planes come into mutual contact while exerting a slight resistive force. The blades deform while forcing the rounded bumps into a recess 84 or 86 provided for this purpose at the base of the groove where the blade is located. Once the rounded bump of each blade has passed to the other side of the rounded bump of the other blade, the two blades return nearly to their initial shapes and are then in contact with one another on their stiff sides. This mechanism has the advantage of enabling each pair of contacts to be retained individually without requiring any other mechanical locking. This way, a connector provided with only one or two pairs instead of four can be manufactured. In addition, the connectors unlock without damage when the plug is accidentally pulled out, whereas the use of an external locking mechanism may cause damage to both the jack and the wall support when the plug is abruptly pulled.

FIG. 4A shows that the contact blade 46 is wider along its rectilinear part 79 than at its end where the contact is made, which comprises a rectilinear part 88, the stiff side, the rounded bump 80 (the location of the actual contact) and the inclined plane. This helps provide good electrical continuity, as explained below.

Figure 7A:
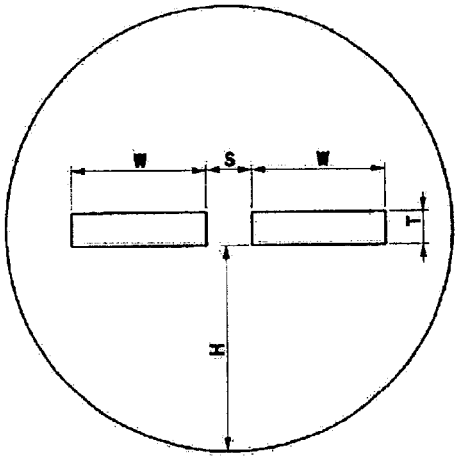
FIGS. 7A and 7B represent, respectively, a cross-section of the connector showing the rectilinear part of the blades, and a cross-section of the connector showing the contact between the contact blades of the two connectors.
Figure 7B:
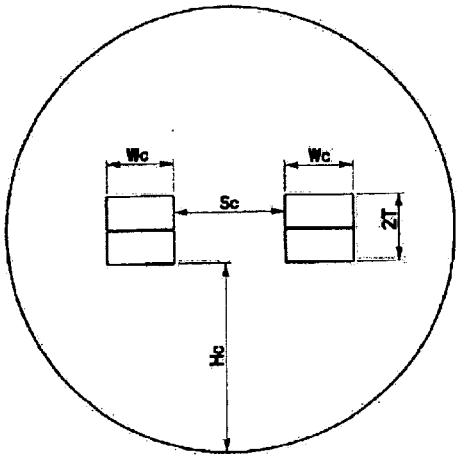

Reference is now made to FIGS. 7A and 7B, which represent cross-section A of the connector showing the single blade 46 in the rectilinear part (see FIG. 6), and cross-section B of the interconnection at the point of contact between the rectilinear part of the blade 46 and the bump 82 of the blade 78 of the other connector, respectively (see FIG. 6). A shown in these figures, the width of each blade shifts from W in its rectilinear part to Wc at the contact point, while the thickness T remains constant.

When taking into consideration the approximations justified by the geometric characteristics commonly used in this technology, the common mode impedance of the contact blades in relation to the shielding cavities is given by the following formula:

$$Zcc = \frac{60}{\sqrt{\varepsilon r}} \mathrm{Ln}\left(\frac{1.9B}{0.8W + T}\right)$$

where B=2H+T is the distance between the reference ground planes, that is to say between the opposite walls in the cavity.

As mentioned previously, the values of the dimensional parameters W and T are selected so that the common mode impedance of the contact blades is equal to the common mode impedance of the twisted pair, that is:

$$Z_{cc}=Z_{pc},$$

The differential mode impedance of the contact blades between themselves, which is equal to the differential mode impedance of the twisted pair, is given by:

$$Z_{cd} = 2Z_{cc}\left(1 - 0.347e^{-29\frac{S}{B}}\right)$$

At the contact point illustrated by FIG. 7B, where the thickness approaches 2T, a different width Wc is needed to maintain a constant common mode impedance. To do this, the following equation must be satisfied:

$$0.8Wc+2T+0.8W+T,$$

which simplifies to:

$$Wc=W-1.25T.$$

The differential mode impedance of the contact blades remains essentially constant, as the only parameter that varies is:

$$1 - 0.347e^{-2.9\frac{S}{B}}$$

although this variation is very low due to the fact that S is replaced by Sc.

The cable side of the connector is closed by the two guillotines 40 and 42 mentioned above (see FIG. 2). These two guillotines slide in two side grooves made in the connector body, and may be pre-positioned in their respective housings when the connectors are manufactured without disrupting the assembly of the connector with the cable. Once the assembly operation is completed, the two guillotines may be pressed together using a pair of parallel pliers in order to close them onto the shielding braid 24 of the cable 22. It is thus important that the guillotines, which are made of conductive material, be in electrical contact with the cable shielding so as to ensure the continuity of the shielding. In order to do this, the braid 24 can be folded back onto the outer jacket of the cable, or a sufficient length of the outer jacket may be removed from the cable so that the guillotines can press on the braid and the film of the four pairs.

Figure 8A:
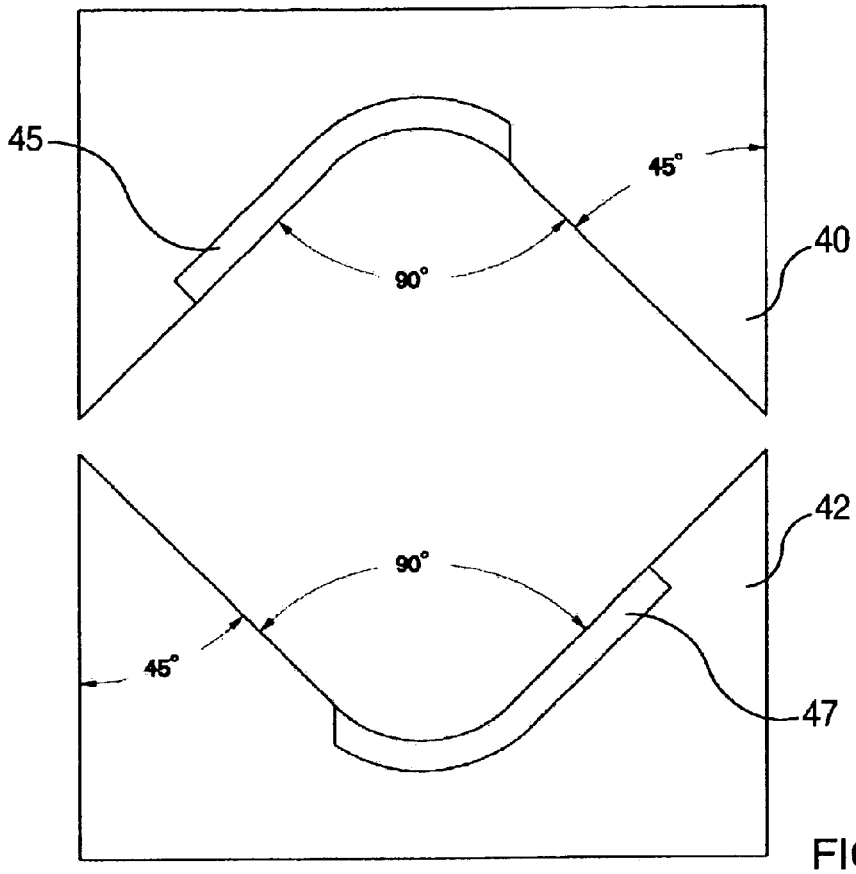
FIGS. 8A and 8B represent, respectively, two positions of the guillotine mechanism in a first embodiment.

When the guillotines 40 and 42 are clamped using pliers, they initially have the positions shown in FIG. 8A. As the clamping operation proceeds, the guillotines are retained by racks located on the sides of the guillotine, such as racks 41 and 43 of the guillotine 40 visible in FIG. 2. When clamping is complete, the guillotines are in the positions shown in FIG. 8B. The racks ensure that the cable is adequately held at all times, regardless of its diameter.

The guillotine mechanism is an important element of the invention. All systems designed to retain a cable in a connector encounter the common problem of ensuring a proper grip and a good 360° seal, while not deforming or damaging the cable so as not to downgrade its electrical performance characteristics or short-circuit any of the twisted pairs. Mechanisms used in the prior art generally have a fixed geometry, and thus suffer the dilemma of correctly maintaining the cable while crushing it, or not deforming the cable at the expense of a poor seal, poor electrical contact, and poor recovery of the stresses endured by the cable. The present invention resolves this advantageously by providing the guillotines with side edges forming a 90° angle between them and a 45° angle in relation to the direction of guillotine movement during the clamping operation. When the guillotines come together to shift from the position illustrated in FIG. 8A to the position illustrated in FIG. 8B, the cable entry hole reduces both vertically and horizontally, and the two side edges form a diaphragm as they approach. In this manner, the cable is clamped uniformly on four sides, which prevents it from being crushed.

Figure 8B:
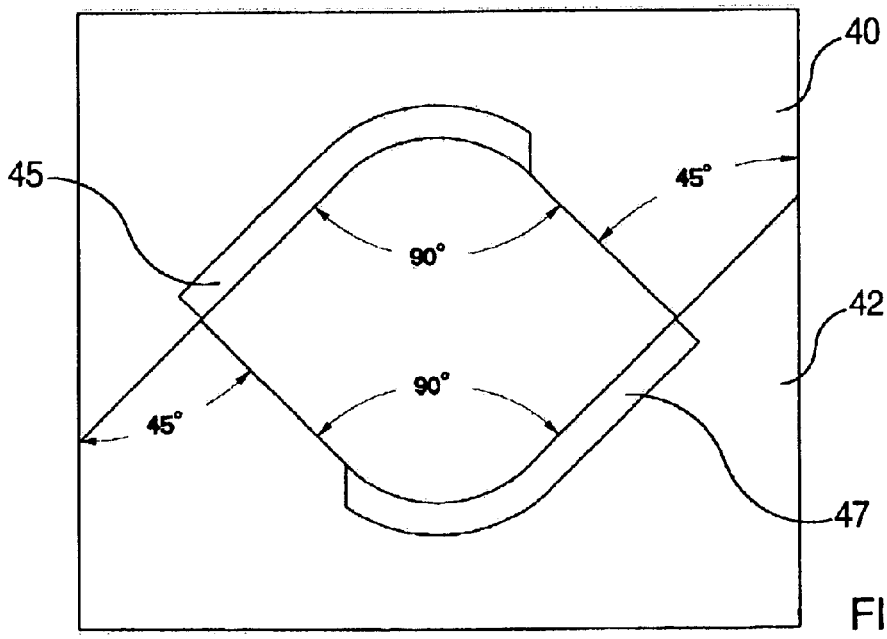
Figure 9:
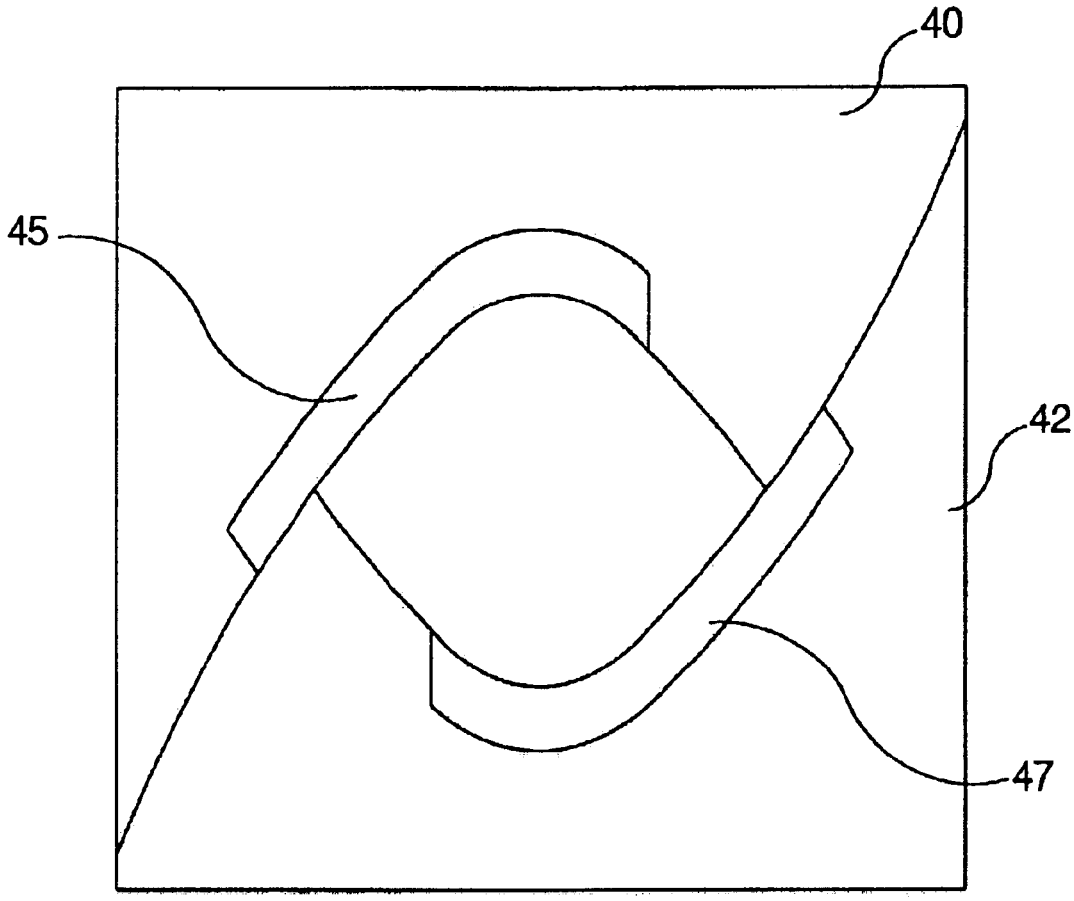
FIG. 9 represents a second embodiment of the guillotine mechanism.

The side edges of the guillotines may be rectilinear in shape as in the embodiment represented in FIGS. 8A and 8B. They may also be curved in shape to fit even better the shape of the cable and to soften the coverage angle between the two parts of the diaphragm as shown in FIG. 9. In the two embodiments, the recess of each guillotine formed by the side edges has a rounded shoulder 45 or 47 which extends along the side edge of each guillotine to provide better pressure distribution on the cable.

Due to its geometric continuity, the interconnection device described above ensures homogenous transmission parameters between the cable and the connector interface block. It offers exceptional ease of use in the field, as no special tools are required. The closing lever of the dressing-block enables a large space to be opened before being folded down onto the conductors which were pre-positioned in the IDCs to ensure the electrical connection. Once the closing lever is pressed down, the assembly forms a cylinder adapted to be inserted into a cylindrical cavity and thus to have a geometry identical to that resulting from the interconnection of the male and female connectors.

I claim:

1. A connector to connect cables of twisted pair for the transmission of very high-frequency differential data signals, in which the conductors of a twisted pair are connected in a connection block by insulation displacement contacts to contact blades, said contact blades including an auto-latching mechanism adapted to ensure contact in an interface block with the corresponding contact blades of another connector, wherein:

each of said contact blades has a constant thickness (T), and has an initial width (W) in a rectilinear part and a narrower second width (Wc) in a portion where contact is made with a corresponding portion of a contact blade of another connector such that the common mode impedance is equal to:

$$Zc = \frac{60}{\sqrt{\varepsilon r}} \mathrm{Ln}\left(\frac{1.9B}{0.8W + T}\right)$$

where Ln stands for neperian logarithm, and B=2H+T, where H is the distance between the middle point of the base of the blade and the wall of a cavity, and is the same in the rectilinear part and in the portion where the contact is made when Wc=W−1.25T.

2. The connector according to claim 1, wherein the portion where contact is made comprises a stiff side, a rounded bump, and an inclined plan, so that when connection is made between said connector and another connector of the same type, the electrical connection between the contact blades of both connectors is made by the contact between the rounded bumps of both blades.

3. The connector according to claim 2, wherein each of said contact blades is placed in a groove of the front part of said dressing-block located in said interface block, said groove having a recess located at the location of said portion where the contact is made so that said blade can occupy said recess during its deformation when the rounded bump of each of the contact blades passes behind the rounded bump of the other contact blade during the connection.

4. The connector according to claim 3, wherein, when connection is made, the geometry of the elements comprising said connection block is the same as the geometry of the elements comprising said interface block, said geometry being adapted so that the differential mode impedance between the conductors of the twisted pair and the common mode impedance between said conductors and the shielding of said pair are equal to the differential mode impedance between said contact blades and the common mode impedance between said contact blades and the shielding of the connector, respectively.

5. The connector according to claim 4, wherein said insulation displacement contacts and said contact blades are included in a plastic dressing-block of cylindrical shape with a circular cross-section, said dressing-block being inserted into cavities of said connection block and said interface block, said cavities having conductive walls and also being of cylindrical shape with circular cross-section.

6. The connector according to claim 5, wherein the cavities into which said dressing-block is inserted include a first cavity of a first diameter located in said interface block and a second cavity of a second diameter located in said connection block, both cavities having a common axis and being connected by a cavity having the shape of a truncated cone, wherein the second diameter is greater than the first diameter.

7. The connector according to claim 6, wherein said connection block includes a rectangular cavity divided into four insulating sub-cavities by two orthogonal conductive walls ensuring the transition from the shielding between the cable part where the shields of the pairs are in contact with the part of the cable where the pairs are separated.

8. The connector according to claim 7, wherein the shield of each pair ends in said second cylindrical cavity such that said rectangular cavity has no influence on the electrical parameters of the twisted pair.

9. The connector according to claim 8, wherein said dressing-block includes a closing lever which enables, when it is open, said contact blades to be installed before being connected to the conductors of an associated twisted pair and to place said conductors encased in an insulating jacket into said insulation displacement contacts, the closure of said closing lever causing the penetration into said insulating jacket of the sharp edges of said insulation displacement contacts connected electrically to said contact blades and thus enabling the electrical connection between said conductors and said contact blades to be made.

10. The connector according to claim 9, wherein said sharp edges of the insulation displacement contacts form an integral part of said contact blades and are located at the end of said contact blades and transversally to them.

11. The connector according to claim 10, wherein one of said contact blades is longer than the other of the contact blades so that, in order to preserve a distance between said contact blades defined by the differential mode impedance, said sharp parts located at the end of said blades are shifted to avoid contact between one another.

12. The connector according to claim 11, further comprising a clamping mechanism to grip the cable when the connection has been made, said clamping mechanism comprising two guillotines sliding in side grooves of said connection block.

13. The connector according to claim 12, wherein the guillotines include racks on their edges to block the guillotines when the guillotines slide in said grooves.

14. The connector according to claim 13, wherein the side edges of said guillotines form a 90° angle between them and a 45° angle in relation to the direction of movement of said guillotines during the clamping operation, such that the side edges of both guillotines form a diaphragm when they approach one another.

15. The connector according to claim 14, in which each guillotine includes a shoulder located in the recess formed by said side edges and extending along a side edge of the guillotine so as to obtain better distribution of the pressure on the cable.

* * * * *